US011322899B2

(12) United States Patent
Fernandes et al.

(10) Patent No.: US 11,322,899 B2
(45) Date of Patent: May 3, 2022

(54) CONNECTOR HOUSING HAVING TERMINAL RETENTION RECESS WITH STOP SURFACE

(71) Applicant: TE Connectivity Services GmbH, Schaffhausen (CH)

(72) Inventors: Stanrich D. Fernandes, Harrisburg, PA (US); William Mattern, York, PA (US); William G. Lindberg, Elizabethtown, PA (US)

(73) Assignee: TE Connectivity Services GmbH, Schaffhausen (CH)

( * ) Notice: Subject to any disclaimer, the term of this patent is extended or adjusted under 35 U.S.C. 154(b) by 27 days.

(21) Appl. No.: 16/925,962

(22) Filed: Jul. 10, 2020

(65) Prior Publication Data

US 2022/0013965 A1 Jan. 13, 2022

(51) Int. Cl.
*H01R 24/28* (2011.01)
*H01R 13/05* (2006.01)

(52) U.S. Cl.
CPC ..... *H01R 24/28* (2013.01); *H01R 13/052* (2013.01)

(58) Field of Classification Search
CPC ..... H01R 13/432; H01R 13/052; H01R 24/28
USPC ..... 439/746–749
See application file for complete search history.

(56) References Cited

U.S. PATENT DOCUMENTS 3,120,988 A * 2/1964 Gilbart ..... H01R 13/26 439/747
3,208,030 A * 9/1965 Evans ..... H01R 13/28 439/290
3,311,867 A * 3/1967 Beauchaine ..... H01R 13/428 439/748
3,530,429 A * 9/1970 Wilfred ..... H01R 13/04 439/746
3,697,934 A * 10/1972 Merry ..... H01R 13/428 439/748
3,957,337 A * 5/1976 Damiano ..... H01R 13/432 439/682
4,589,721 A * 5/1986 Sedig ..... H01R 13/428 439/748
4,620,766 A * 11/1986 Leonard ..... H01R 13/432 439/748
5,597,330 A 1/1997 Hatagishi
9,065,205 B2 6/2015 Gao et al.

* cited by examiner

*Primary Examiner* — Gary F Paumen

(57) ABSTRACT

An electrical connector having a housing with at least one contact receiving passageway extending from an insertion face to a mating face. The contact receiving passageway has a wall extending about the perimeter of the contact receiving passageway. A contact is insertable into the contact receiving passageway from the insertion face toward the mating face. The contact has a mounting portion positioned in the contact receiving passageway. The contact has a lance which extends outward from the mounting portion. A recess extends from the contact receiving passageway into the wall of the contact receiving passageway. The recess has a stop surface and a lead-in surface. The lance cooperates with the stop surface of the recess to properly position and retain the contact in the at least one contact receiving passageway.

19 Claims, 5 Drawing Sheets

CONNECTOR HOUSING HAVING TERMINAL RETENTION RECESS WITH STOP SURFACE

FIELD OF THE INVENTION

The invention is directed to a connector housing with a terminal retention recess with a stop surface. In particular, the invention is directed to a terminal retention recess which cooperates with a terminal lance to properly position and retain a terminal in the connector housing.

BACKGROUND OF THE INVENTION

Contacts insertable into passageways of connector housings require assured mechanisms to be retained in the contact receiving passageways after insertion. Each stamped and formed contact commonly rely on a lance cooperating with shoulders along one or more walls of the contact receiving passageway to resist withdrawal of the contact in a direction opposed to the direction of insertion. The lance is commonly deflectable during insertion until passing a shoulder of the contact receiving passageway, at which point the lance is resiliently returned to an unstressed position. However, as the dimensions of the contact receiving passageway vary from the dimensions of the contact, a large gap or space may be provided between the shoulder and the lance, thereby preventing the lance from properly positioning the contact in the contact receiving passageway.

In other connector housings, the lance of the contact engages a wall of the contact receiving passageway. In connector housings in which the housing material is soft, the lance can slightly displace or penetrate the housing material, causing the housing to become lodged in the wall of the contact receiving passageway. This allows the lance to provide sufficient retention force to properly position and maintain the contact receiving passageway. However, in housings made from more rigid material, such as glass filled resins, the lance cannot displace or penetrate the housing material. Consequently, the lance slides across the wall of the contact receiving passageway, resulting in lower retention forces and the inability of the lance to properly position the contact in the contact receiving passageway.

It is desired to provide a lance receiving recess in a contact receiving passageway which overcomes the problems of the prior art. It would, therefore, be beneficial to provide a lance receiving recess which cooperates with a lance of a contact to provide proper terminal retention force, regardless of the material of which the connector housing is made. It would also be beneficial to provide a lance receiving recess which cooperates with a lance of a contact to properly position the contact in the contact receiving passageway.

SUMMARY OF THE INVENTION

The following provides a summary of certain illustrative embodiments of the present invention. This summary is not an extensive overview and is not intended to identify key or critical aspects or elements of the present invention or to delineate its scope.

An embodiment is directed to an electrical connector having a housing with at least one contact receiving passageway extending from an insertion face to a mating face. The contact receiving passageway has a wall extending about the perimeter of the contact receiving passageway. A contact is insertable into the contact receiving passageway from the insertion face toward the mating face. The contact has a mounting portion positioned in the contact receiving passageway. The contact has a lance which extends outward from the mounting portion. A recess extends from the contact receiving passageway into the wall of the contact receiving passageway. The recess has a stop surface and a lead-in surface. The lance cooperates with the stop surface of the recess to properly position and retain the contact in the contact receiving passageway.

An embodiment is directed to an electrical connector having a housing with at least one contact receiving passageway extending from an insertion face to a mating face. The contact receiving passageway has a mating contact receiving cavity which extends from the mating face. The mating contact receiving cavity has a retention wall which is spaced from the mating face and extends parallel to the mating face. A lance receiving recess is provided on the retention wall. The lance receiving recess extends from the mating contact receiving cavity into the retention wall of the mating contact receiving cavity. The lance receiving recess has a stop surface. A contact is insertable into the contact receiving passageway from the insertion face toward the mating face. The contact has a mounting portion positioned in the mating contact receiving cavity. The contact has a lance extending outward from the mounting portion. A free end of the lance is moved into the lance receiving recess and cooperates with the stop surface of the lance receiving recess to properly retain and maintain the position of the contact in the contact receiving passageway.

An embodiment is directed to an electrical connector having a housing with a contact receiving passageway extending from an insertion face to a mating face. The contact receiving passageway has a retention wall which projects into the contact receiving passageway from a side wall of the contact receiving passageway. A lance receiving recess is provided on the retention wall. The lance receiving recess extends from a surface of the retention wall. The lance receiving recess has a stop surface and a lead-in surface. A contact is positioned in the contact receiving passageway. The contact has a mounting portion positioned proximate the retention wall of the contact receiving passageway. A lance extends outward from the mounting portion. The lance has a free end spaced from the mounting portion. A force applied to the contact in a direction opposed to the direction of insertion of the contact into the contact receiving passage causes the free end of the lance to be moved into the lance receiving recess wherein the lance cooperates with the stop surface of the lance receiving recess to properly retain and maintain the position of the contact in the contact receiving passageway.

Additional features and aspects of the present invention will become apparent to those of ordinary skill in the art upon reading and understanding the following detailed description of the illustrative embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more illustrative embodiments of the invention and, together with the general description given above and detailed description given below, serve to explain the principles of the invention, and wherein.

DETAILED DESCRIPTION OF THE INVENTION

Figure 1:
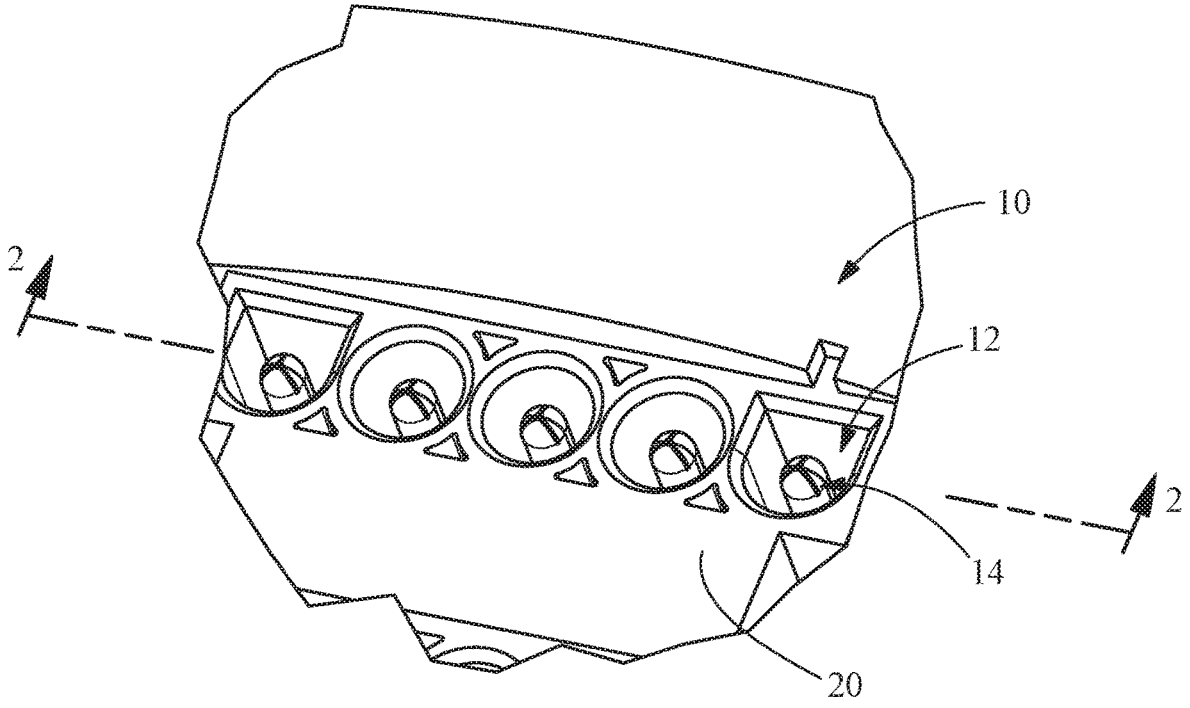
FIG. 1 is a perspective view of an illustrative electrical connector with contact inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Illustrative embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

As shown in FIG. 1, an illustrative electrical connector 10 has contact receiving passageways 12 with contacts 14 provided therein. In the embodiment shown, the electrical connector 10 has a single row of five contact receiving passageways, but other configurations and other numbers of contact receiving passageways 12 may be used.

Figure 2:
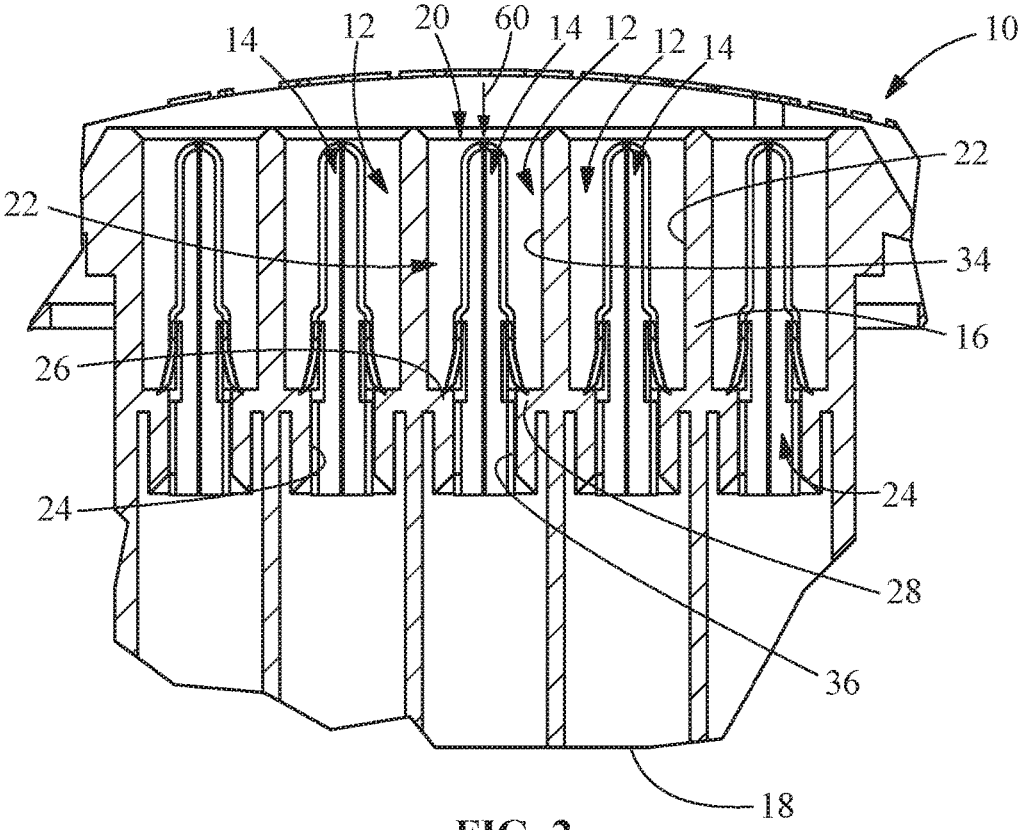
FIG. 2 is a cross-sectional view of the electrical connector of FIG. 1 taken along line 2-2.

As shown in FIG. 2, the electrical connector 10 has a housing 16 with at least one contact receiving passageway 12 extending from an insertion face 18 to a mating face 20. The contact receiving passageway 12 includes a mating contact receiving cavity 22 which extends from the mating face 20 and a conductor receiving cavity 24 which extends from the insertion face 18. A retention wall 26 is provided at an end of the mating contact receiving cavity 22 which is spaced from the mating face 20 of the housing 16. The retention wall 26 is the transition between the mating contact receiving cavity 22 and the conductor receiving cavity 24. In the illustrative embodiment shown, the retention wall 26 extends about the circumference of the mating contact receiving cavity 22 and is parallel to the mating face 20.

Figure 3:
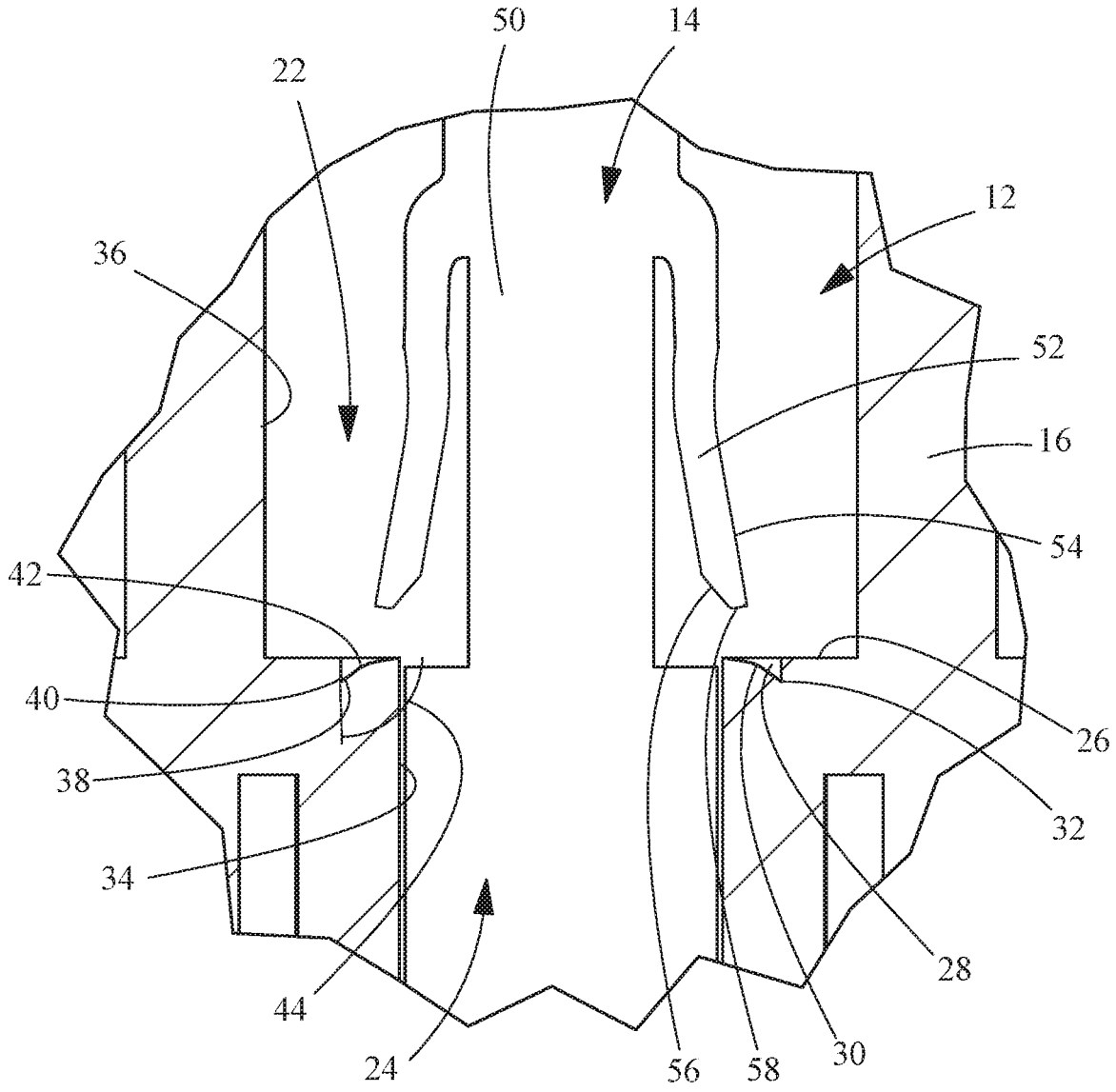
FIG. 3 is an enlarged view of area 3 of FIG. 2, showing a lance proximate a lance receiving recess.
Figure 4:
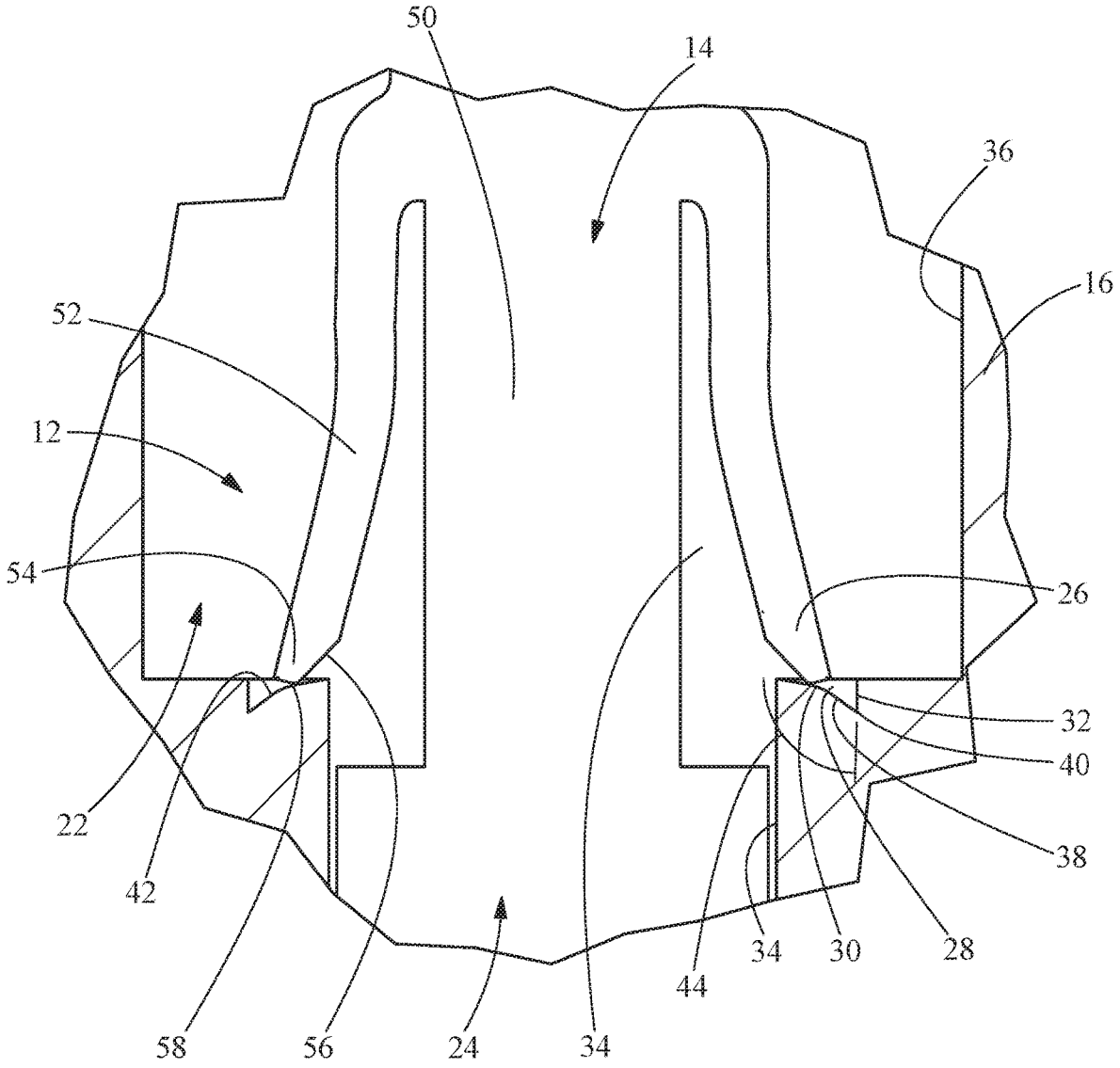
FIG. 4 is a view similar to FIG. 3, showing the lance engaging a lead-in surface of the lance receiving recess.
Figure 5:
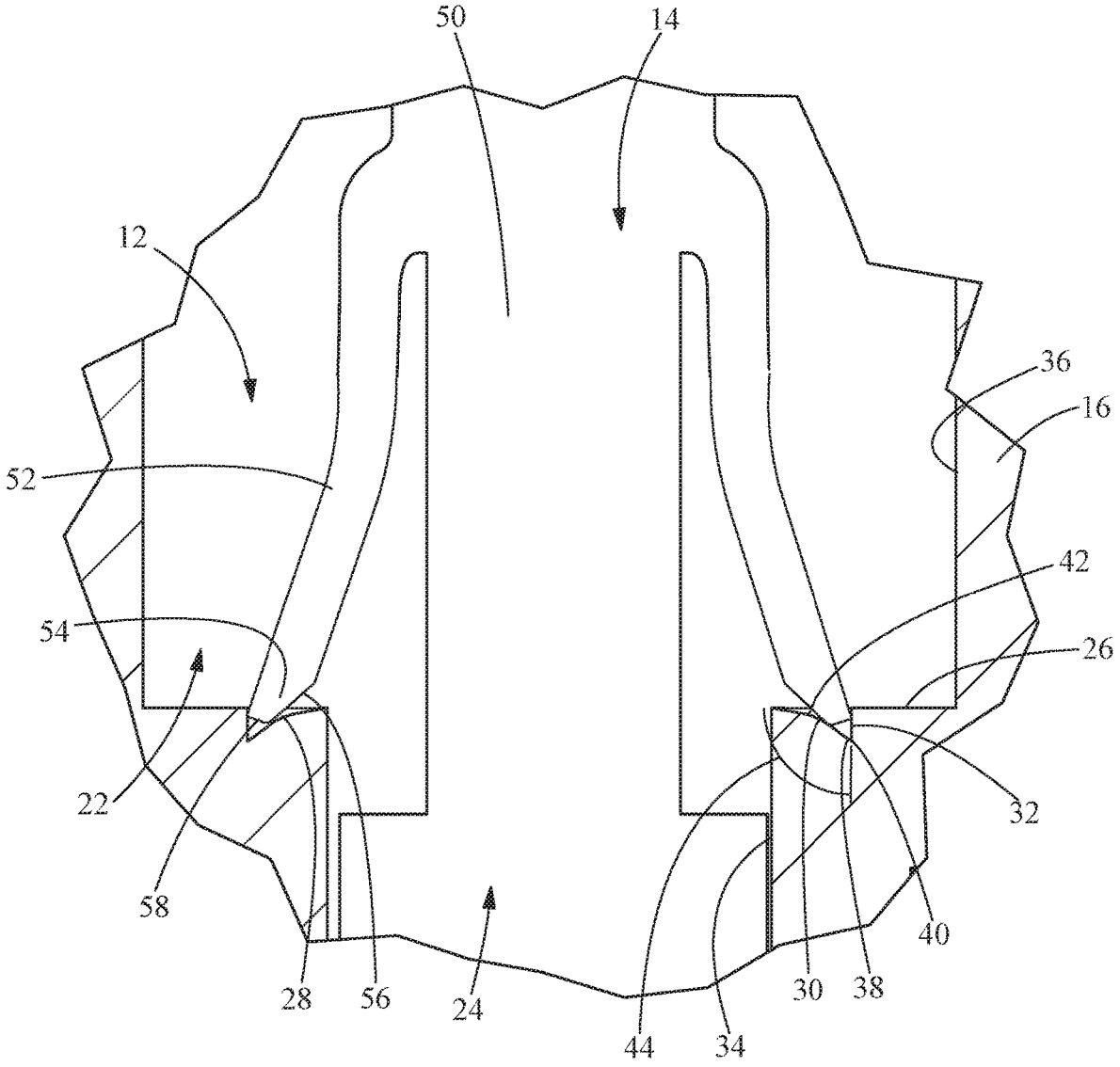
FIG. 5 is a view similar to FIG. 3, showing the lance engaging a stop surface of the lance receiving recess.

As shown in FIGS. 3 through 5, at least one lance receiving recess 28 is provided on the retention wall 26. The lance receiving recess 28 extends from the mating contact receiving cavity 22 into the retention wall 26 of the mating contact receiving cavity 22. The lance receiving recess 28 has a lead-in surface 30 and a stop surface 32. The lance receiving recess 28 extends from proximate a side wall 34 of the conductor receiving cavity 24 toward a side wall 36 of the mating contact receiving cavity 22. The stop surface 32 is positioned closer to the side wall 36 of the mating contact receiving cavity 22 and the lead-in surface is positioned closer to the side wall 34 of the conductor receiving cavity 24.

The lead-in surface 30 extends from the surface of the retention wall 26 of the mating contact receiving cavity 22. An end 38 of the lead-in surface 30 is spaced from the surface of the retention wall 26 of the mating contact receiving cavity 22 and is adjacent or abuts an end 40 of the stop surface 32 which is spaced from the surface of the retention wall 26 of the mating contact receiving cavity 22.

Figure 6:
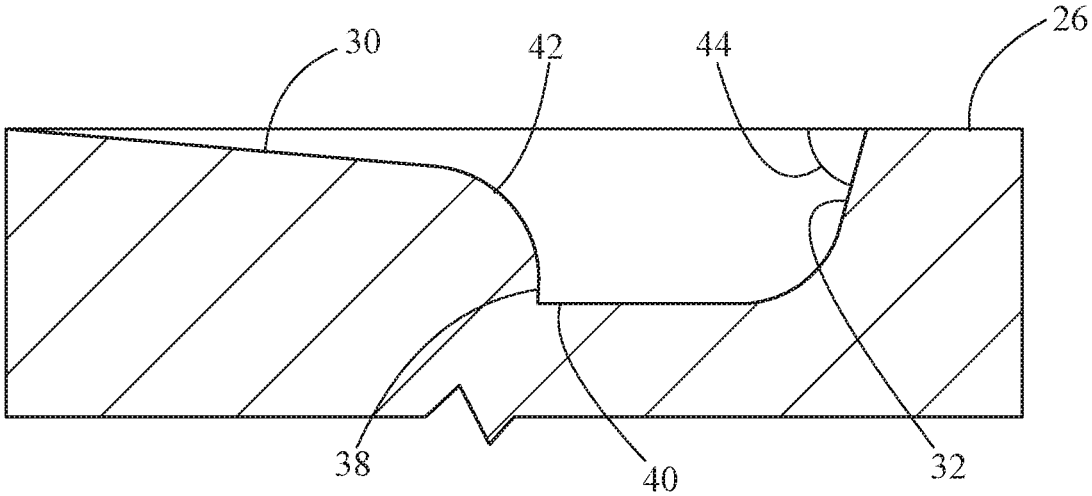
FIG. 6 is a cross sectional view of a first alternate lance receiving recess.
Figure 7:
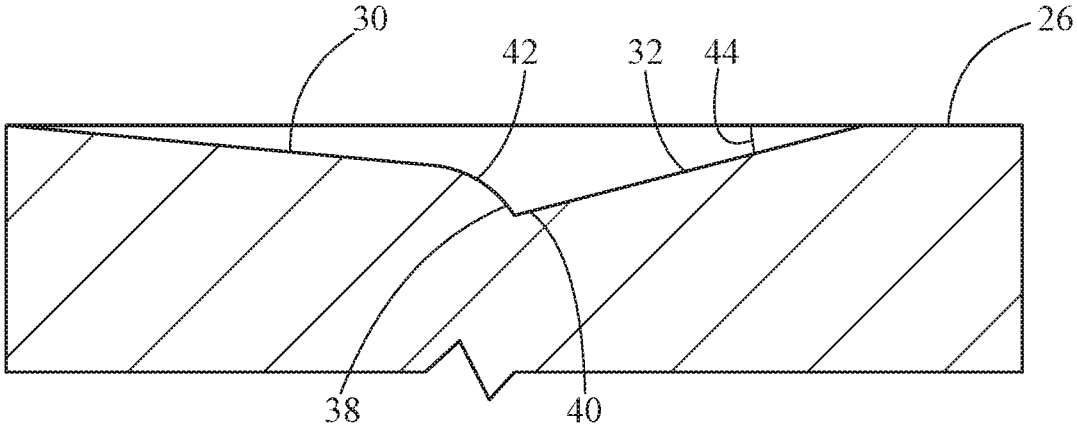
FIG. 7 is a cross sectional view of a second alternate lance receiving recess.

An intermediate portion 42 of the lead-in surface 30 of the lance receiving recess 28 extends in a direction away from the end 40 of the stop surface 32 and away from the side wall 36 of the mating contact receiving cavity 22. In the embodiment shown in FIGS. 3 through 5, the intermediate portion 42 of the lead-in surface 30 of the lance receiving recess 28 is planar. However, in other embodiments, as illustrated in FIGS. 6 and 7, intermediate portion 42 of the lead-in surface 30 of the lance receiving recess 28 is nonplanar.

The stop surface 32 extends at an angle 44 from the surface of the retention wall 26 of the mating contact receiving cavity 22. The angle 44 may be an acute angle (as shown in FIGS. 6 and 7) or a right angle (as shown in FIGS. 3 through 5). The stop surface may be planar (as shown in FIGS. 3 through 5 and 7) or may be nonplanar as shown in FIG. 6.

As shown in FIGS. 2 through 5, the contact 14 is a male contact pin. However other embodiments may be used. For example, the contact 14 may be a female socket contact. The contact 14 has a mounting portion 50 with mounting lances 52 extending outward from the mounting portion 50. Ends 54 of the lances 52 have a first surface 56 and a second surface 58.

In use, the contact 14 is inserted into the contact receiving passageway 12 of the housing 16 through the insertion face 18 toward the mating face 20. As this occurs, the mounting portion 50 is moved through the conductor receiving cavity 24 of the contact receiving passageway 12. As the mounting portion 50 of the contact 14 has a similar diameter to the diameter of the conductor receiving cavity 24, the lances 52 of the mounting portion 50 are resiliently deformed inward.

Insertion of the contact 14 continues until the mounting portion 50 of the contact 14 is moved into the mating contact receiving cavity 22 of the contact receiving passageway 12, as shown in FIG. 3. In this position, the lances 52 are moved past the side wall 34 of the conductor receiving cavity 24, allowing the lances 52 to resiliently return to their unstressed position and move toward the side wall 36 of the mating contact receiving cavity 22.

With the contact 14 properly positioned in the contact receiving passageway 12, the end of the contact 14 must be retained in position proximate to the mating face 20 in order to facilitate the proper electrical connection between the connector 10 and a mating connector (not shown). Consequently, if a force is applied to the contact 14 in a direction toward the insertion face 18, as represented by arrow 60 in FIG. 2, the contact 14 must be prevented from withdrawing from the mating contact receiving cavity 22 of the contact receiving passageway 12.

As the force is applied, the mounting portion 50 of the contact 14 is moved toward the conductor receiving cavity 24, as shown in FIG. 4. As this occurs, the second surfaces 58 of the ends 54 of the lances 52 engage the retention wall 26.

If the force is continued, the second surfaces 58 of the ends 54 of the lances 52 are moved into the lance receiving recesses 28 provided on the retention wall 26. With continued force, the second surfaces 58 engage and slide across the lead-in surfaces 30 of the lance receiving recess 28 until the second surfaces 58 engage the stop surfaces 32. The lead-in surfaces 30 of the lance receiving recess guide the ends 54 of the lances 52 toward the stop surfaces 32. As shown in FIG. 5, in this position, the second surfaces 58 of the lances 52 engage the stop surfaces 32 to prevent further movement of the lances 52 and the contact 14 toward the wall 36 of the mating contact receiving cavity 22 of the contact receiving passageway 12. Also in this position, the first surfaces 56 of the ends 54 of lances 52 engage the lead-in surface 30 of the lance receiving recess 28 to prevent further movement of the lances 52 and the contact 14 toward the conductor receiving cavity 24 of the contact receiving passageway 12 and the mating face 20.

The cooperation of the end 54 of the lance 52 with the lead-in surface 30 and the stop surface 32 of the lance receiving recess 28 properly retains and maintains the position of the contact 14 in the mating contact receiving cavity 22 of the contact receiving passageway 12.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having at least one contact receiving passageway extending from an insertion face to a mating face, the at least one contact receiving passageway having a mating contact receiving cavity which extends from the mating face and a conductor receiving cavity which extends from the insertion face, the mating contact receiving cavity having a side wall which extends from the mating face;

a retention wall provided in the mating contact receiving cavity, the retention wall being spaced from the mating face and extending parallel to the mating face;

a contact insertable into the at least one contact receiving passageway from the insertion face toward the mating face, the contact having a mounting portion positioned in the at least one contact receiving passageway, the contact having a lance extending outward from the mounting portion;

a lance receiving recess extending from the mating contact receiving cavity into the retention wall, the lance receiving recess having a stop surface and a lead-in surface, the stop surface being spaced from the side wall of the mating contact receiving cavity;

wherein the lance cooperates with the stop surface of the lance receiving recess to prevent further movement of the contact and to properly position and retain the contact in the mating contact receiving cavity of the at least one contact receiving passageway.

2. The electrical connector as recited in claim 1, wherein an end of the lead-in surface which is removed from the side wall of the mating contact receiving cavity of the at least one contact receiving passageway, the end of the lead-in surface is adjacent an end of the stop surface.

3. The electrical connector as recited in claim 1, wherein an intermediate portion of the lead-in surface of the recess extends from an end of the lead-in surface in a direction toward the stop surface.

4. The electrical connector as recited in claim 1, wherein the lead-in surface is a nonplanar surface.

5. The electrical connector as recited in claim 1, wherein the stop surface is a planar surface which extends at an acute angle from the retention wall of the at least one contact receiving passageway.

6. The electrical connector as recited in claim 1, wherein the stop surface is a planar surface which extends perpendicular to the retention wall of the at least one contact receiving passageway.

7. An electrical connector comprising:

a housing having at least one contact receiving passageway extending from an insertion face to a mating face, the at least one contact receiving passageway having a mating contact receiving cavity extending from the mating face, the mating contact receiving cavity having a retention wall which is spaced from the mating face and extends parallel to the mating face, the mating contact receiving cavity having a side wall which extends from the mating face;

a lance receiving recess provided on the retention wall, the lance receiving recess extending from the mating contact receiving cavity into the retention wall of the mating contact receiving cavity, the lance receiving recess having a stop surface, the stop surface being spaced from the side wall of the mating contact receiving cavity;

a contact insertable into the at least one contact receiving passageway from the insertion face toward the mating face, the contact having a mounting portion positioned in the mating contact receiving cavity, the contact having a plurality of lances extending outward from the mounting portion;

wherein free ends of the plurality of lances are moved into the lance receiving recess and cooperate with the stop surface of the lance receiving recess to properly retain and maintain the position of the contact in the mating contact receiving cavity of the at least one contact receiving passageway.

8. The electrical connector as recited in claim 7, wherein the lance receiving recess has a lead-in surface which guides a free end of the lance toward the stop surface.

9. The electrical connector as recited in claim 8, wherein the stop surface is positioned closer to the side wall than the lead-in surface.

10. The electrical connector as recited in claim 9, wherein the lead-in surface extends from a surface of the retention wall.

11. The electrical connector as recited in claim 10, wherein an end of the lead-in surface which is spaced from the surface of the retention wall of the mating contact receiving cavity is adjacent an end of the stop surface which is spaced from the surface of the retention wall of the mating contact receiving cavity.

12. The electrical connector as recited in claim 10, wherein an intermediate portion of the lance receiving recess extends to an end of the lead-in surface which is spaced from the surface of the retention wall of the mating contact receiving cavity.

13. The electrical connector as recited in claim 11, wherein the lead-in surface is a nonplanar surface.

14. The electrical connector as recited in claim 13, wherein the stop surface is a planar surface which extends at an acute angle from the surface of the retention wall of the mating contact receiving cavity.

15. The electrical connector as recited in claim 13, wherein the stop surface is a planar surface which extends perpendicular to the surface of the retention wall of the mating contact receiving cavity.

16. An electrical connector comprising:

a housing having a contact receiving passageway extending from an insertion face to a mating face, the contact receiving passageway having a mating contact receiving cavity which extends from the mating face and a conductor receiving cavity which extends from the insertion face, the mating contact receiving cavity having a side wall which extends from the mating face, a retention wall projects into the contact receiving passageway from a side wall of the mating contact receiving cavity;

a lance receiving recess provided on the retention wall, the lance receiving recess extending from a surface of the retention wall, the lance receiving recess having a stop surface and a lead-in surface, the stop surface being spaced from the side wall of the mating contact receiving cavity;

a contact positioned in the contact receiving passageway, the contact having a mounting portion positioned proximate the retention wall of the contact receiving passageway, a lance extends outward from the mounting portion, the lance having a free end spaced from the mounting portion;

wherein a force applied to the contact in a direction opposed to the direction of insertion of the contact into the contact receiving passage causes the free end of the lance to be moved into the lance receiving recess;

wherein the lance cooperates with the stop surface of the lance receiving recess to prevent further movement of the contact and to properly retain and maintain the position of the contact in the mating contact receiving cavity of the contact receiving passageway.

17. The electrical connector as recited in claim 16, wherein the stop surface of the lance receiving recess is positioned closer to the side wall of the mating contact receiving cavity than the lead-in surface.

18. The electrical connector as recited in claim 16, wherein the lead-in surface is a nonplanar surface.

19. The electrical connector as recited in claim 16, wherein the stop surface is a planar surface which extends perpendicular to the surface of the retention wall of the mating contact receiving cavity.

* * * * *